US009498812B2

(12) United States Patent
Nikhare

(10) Patent No.: US 9,498,812 B2
(45) Date of Patent: Nov. 22, 2016

(54) DIE FOR REDUCING SPRINGBACK AND PROCESS THEREOF

(71) Applicant: The Penn State Research Foundation, University Park, PA (US)

(72) Inventor: Chetan P. Nikhare, Erie, PA (US)

(73) Assignee: The Penn State Research Foundation, University Park, PA (US)

( * ) Notice: Subject to any disclaimer, the term of this patent is extended or adjusted under 35 U.S.C. 154(b) by 76 days.

(21) Appl. No.: 14/465,920

(22) Filed: Aug. 22, 2014

(65) Prior Publication Data

US 2015/0059427 A1 Mar. 5, 2015

Related U.S. Application Data

(60) Provisional application No. 61/870,400, filed on Aug. 27, 2013.

(51) Int. Cl.
*B21D 22/20* (2006.01)

(52) U.S. Cl.
CPC ..... *B21D 22/20* (2013.01)

(58) Field of Classification Search
CPC ..... B21D 22/00; B21D 22/02; B21D 22/06; B21D 22/20; B21D 22/22
USPC ..... 72/75, 112
See application file for complete search history.

(56) References Cited

U.S. PATENT DOCUMENTS 2,286,255 A * 6/1942 Brooks ..... B21D 7/06 72/213
2,977,208 A * 3/1961 Harper ..... C06B 23/007 149/46
3,613,427 A * 10/1971 Haddon ..... B21D 5/08 72/212
4,603,541 A * 8/1986 Medwed ..... B29C 51/04 493/338
5,832,963 A * 11/1998 Hornisch ..... H05K 13/0092 140/105

* cited by examiner

*Primary Examiner* — Teresa M Ekiert
(74) *Attorney, Agent, or Firm* — Dinsmore & Shohl LLP

(57) ABSTRACT

A sheet metal forming device and a process for reducing springback during forming of sheet metal. The sheet metal forming device includes a die tool that has a corner and a roller that at least partially forms the corner. The roller rotates relative to the die tool during and/or after forming of a piece of sheet metal around the corner. The rotation of the roller can be either a rotation that freely occurs during the forming process or rotation that is forcibly imposed on the roller during and/or after the forming process.

15 Claims, 7 Drawing Sheets

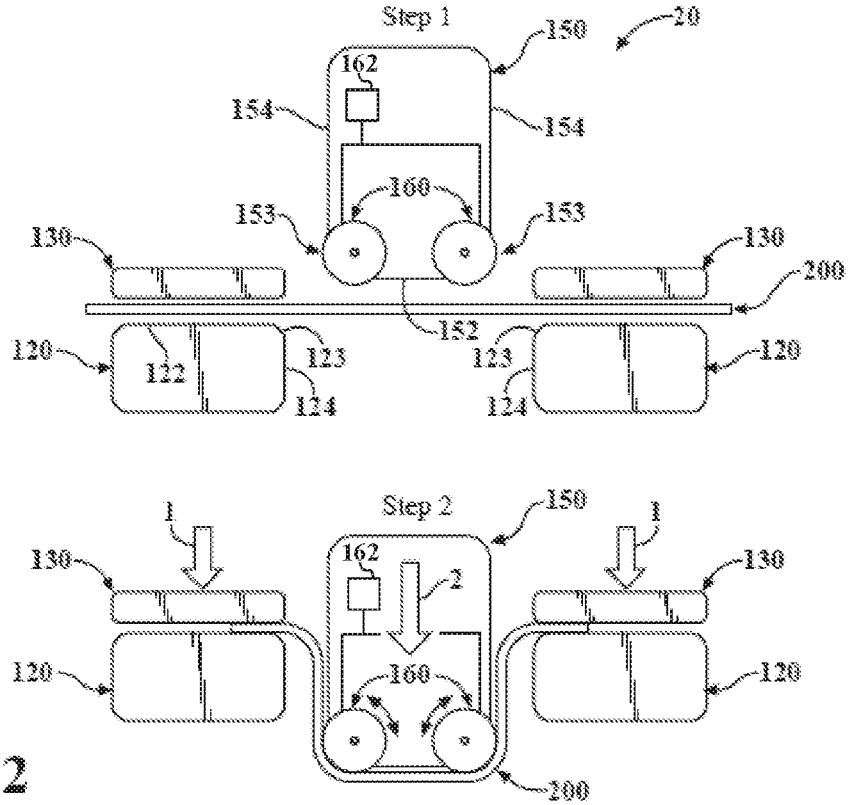
FIG. 2
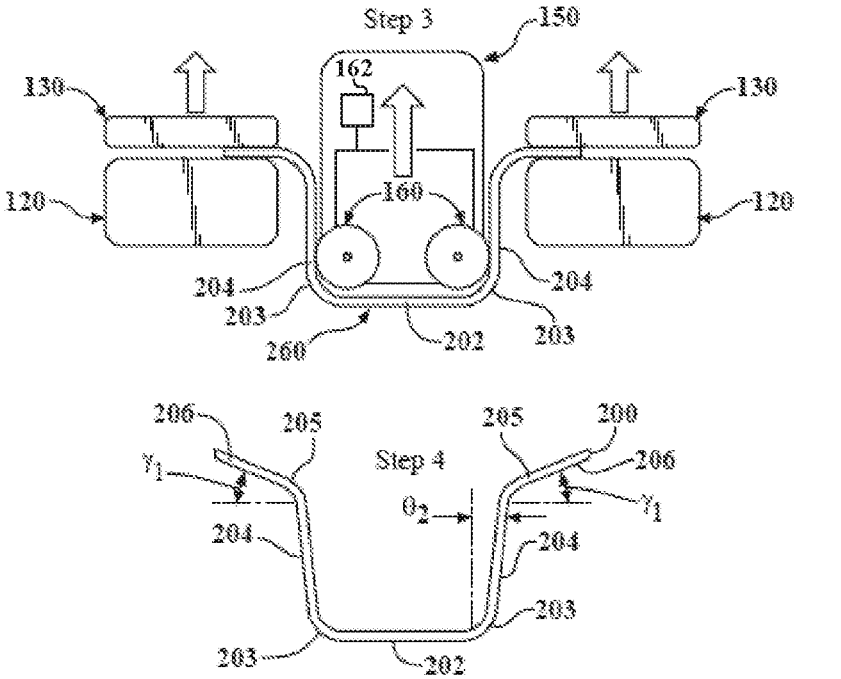

DIE FOR REDUCING SPRINGBACK AND PROCESS THEREOF

CROSS-REFERENCE TO RELATED APPLICATIONS

This application priority of U.S. Provisional Application 61/870,400 filed Aug. 27, 2013, the contents of which are incorporated herein by reference.

FIELD OF THE INVENTION

The present invention is directed to a metal forming die and in particular to a metal forming die with a roller that reduces springback during metal forming of sheet metal components.

BACKGROUND OF THE INVENTION

Metal forming of sheet metal using processes such as deep drawing and the like are known. In addition, the phenomenon "springback" is known and refers to sheet metal that has been bent, formed, etc. and then returns at least partially to its original shape after the forming process. As such, different methods have been developed to deal with the amount of springback exhibited by different materials, such methods including over bending of a piece of sheet metal in an attempt to anticipate the amount of springback that occurs, hot forming of the material during the forming process, and the like. However, such methods have proven unsuitable in certain situations and thus an improved sheet metal forming process and/or dies for sheet metal forming would be desirable.

SUMMARY OF THE INVENTION

A sheet metal forming device and a process for forming sheet metal is provided. The sheet metal forming device includes a die tool that has a corner and a roller that at least partially forms the corner of the die tool. In addition, the roller rotates relative to the die tool during forming of a piece of sheet metal around the corner.

The rotation of the roller can be either a rotation that freely occurs during the forming process or rotation that is forcibly imposed on the roller during and/or after positive movement/displacement of the die to form the sheet metal. Naturally, the forcible rotation is afforded by the roller being mechanically connected to a power source that provides power and/or rotation to the roller.

The die tool can be a male die (MD) tool or a female die (FD) tool. In some instances, the sheet metal forming device includes an MD tool and an FD tool. Furthermore, the MD tool can have an MD roller that forms at least part of the MD tool, the roller rotating during at least part of the sheet metal forming process. Furthermore, the MD tool can have a pair of MD corners and a pair of MD rollers, with one roller at each MD corner.

A process for forming sheet metal includes providing the sheet metal forming device and placing a piece of sheet metal over an opening such that the MD tool with the MD rollers forms the sheet metal within the opening and over or around the MD rollers. In addition, the MD rollers can be forcibly rotated during the forming process, and optionally after the MD tool has stopped its motion into the opening. In this manner, the MD roller rotates against the sheet metal material at the corner location during and/or after movement of the MD tool in a direction that forms the sheet metal component.

BRIEF DESCRIPTION OF THE DRAWINGS

FIG. 2 is a schematic illustration of a sheet metal forming process according to an embodiment disclosed herein;

DETAILED DESCRIPTION OF THE INVENTION

Figure 1:
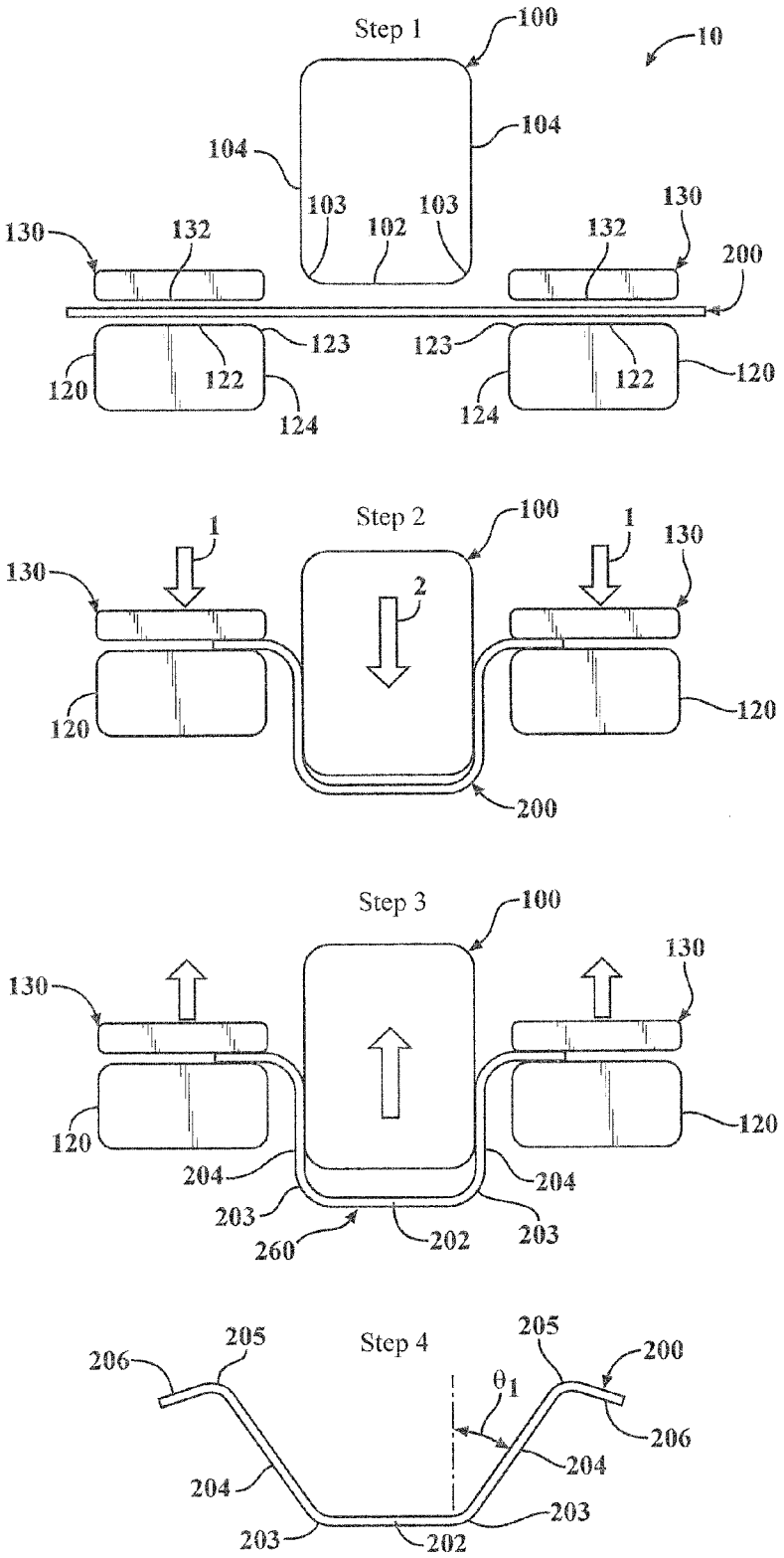
FIG. 1 PRIOR ART
FIG. 1 is a schematic illustration of a prior art sheet metal forming process.

A sheet metal forming device that reduces springback and a process for forming sheet metal that reduces springback is provided. As such, the sheet metal forming device and the process have use in the manufacture of sheet metal components.

The sheet metal forming device includes a die tool that has a corner and a roller that at least partially forms the corner of the die tool. In addition, the roller rotates relative to the die tool during forming of a piece of sheet metal. Stated differently, as the die tool is forced against the piece of sheet metal, and thus deforms the sheet metal, the roller that is located at a corner of the die tool rotates and reduces springback of the formed sheet metal.

The roller can rotate freely during the forming process and/or be forcibly rotated during the forming process. It is appreciated that the terms "rotate freely", "free rotation", "friction induced rotation", etc., refer to the roller rotating against the sheet metal component in response to movement of the sheet metal against the roller during the forming process. It is also appreciated that the terms "rotating forcibly", "forcibly rotating", etc., refers to the roller rotating due to an external mechanical force that does not include the sheet metal component. For example and for illustrative purposes only, the external mechanical force can include an electric motor mechanically coupled to the roller, a gas powered motor coupled to the roller, and the like. As such, the forcible rotation of the roller affords for the roller to rotate against the sheet metal component in contact therewith even after the sheet metal component has stopped moving relative to the die tool, e.g. after the die tool has stopped moving in a positive direction during the forming process.

Not being bound by theory, rotation of the roller relative to the sheet metal can provide frictional heat to the sheet metal in contact therewith, vibrational energy to the sheet metal in contact therewith, release residual stress in the contact region, etc. In addition, the frictional heat, vibrational energy, residual stress release, etc. affords for a reduction in springback of the sheet metal component after the die tool is removed from contact with the sheet metal and the sheet metal component is removed from the sheet metal forming device.

In some instances, the sheet metal component is formed using a male die tool and a female die tool. For example, the male die tool can be a punch die tool that moves relative to a female die tool, e.g. during a drawing or deep drawing operation. In addition, the male die tool and/or the female die tool can have one or more corners that come into contact with the sheet metal and the one or more corners can have a roller that forms at least part of the corner. Also, the roller rotates relative to the die tool during the forming of the piece of sheet metal. In this manner, sheet metal material is formed with die tools that have a roller at at least one corner thereof, rotation of the roller affording for reduced springback of the formed sheet metal component.

Turning now to FIG. 1, a prior art sheet metal forming device and process is shown generally at reference numeral 10. The metal forming device 10 includes a male die tool 100 that has a bottom surface 102, a pair of side surfaces 104, and a pair of corners 103 in between the bottom surface 102 and the side surfaces 104. The metal forming device 10 also includes a female die tool 120 and a clamping tool 130. Located between the female die tool 120 and the clamping tool 130 is a piece of sheet metal 200.

The female die tool 120 has an upper surface 122, a side surface 124, and a corner 123 between the upper surface 122 and the side surface 124. The clamping tool 130 has a bottom surface 132 and the piece of sheet metal 200 can be clamped between the female die tool 120 and the clamping tool 130 upon application of force as illustrated by the arrows 1 in Step 2. It is appreciated that the female die tool 120 and/or clamping tool 130 can be a pair of die tools, or in the alternative a single die tool which is shown in cross section in FIG. 1. Stated differently, FIG. 1 illustrates any male die tool 100 and female die tool 120 known to those skilled in the art of sheet metal forming.

As shown in Step 2, the piece of sheet metal 200 is clamped between the female die tool 120 and clamping tool 130 and the male die tool 100 is moved in a positive direction as shown by the arrow labeled 2, such that the sheet metal 200 is formed into the shape of the tool 100. Furthermore, and as known to those skilled in the art, the force applied to the clamping tool 130 is such that the sheet metal 200 is allowed to slide between the female tool 120 and clamping tool 130 and yet provide sufficient resistance such that a desired shape is formed by the male tool 100. It is appreciated that the terms "positive direction", "positive movement", "positive displacement", etc. used herein refer to movement of the die tool in a direction that deforms the sheet metal component, as opposed to "negative direction", "negative movement", "negative displacement", etc., which refers to withdrawal of the die tool after active forming of the sheet metal component has been completed.

Referring to Step 3, after the male tool 100 has extended between or into the female tool 120 a desired distance or depth, the tool 100 is moved in a negative direction. In addition, the piece of sheet metal 200 has a shape with a bottom portion 202, side portions 204, and corner portions 203 between the bottom portion 202 and side portions 204. However, and as shown at Step 4, after the piece of sheet metal 200 is removed from the sheet metal forming device 10, the sheet metal material springs back in an attempt to return to its original shape. One measure of springback is shown by the angle $\theta_1$ that shows a measure of how much the side portion 204 moves away from a generally right angle position relative to the bottom portion 202.

Turning now to FIG. 2, an inventive sheet metal forming device is shown generally at reference numeral 20. Similar to FIG. 1, Step 1 illustrates the piece of sheet metal 200 between the female die tool 120 and clamping tool 130. However, the male die tool 150 has a pair of corners 153 at least partially formed by a pair of rollers 160. As such, the rollers 160 form at least part of the corners 153 that are present between the bottom surface 152 and the side surfaces 154 of the male die tool 150.

Similar to Step 2 in FIG. 1, the male die tool 150 moves in a positive direction within the female die tool 120 such that the piece of sheet metal 200 is shaped to conform with the male die tool 150. However, the rollers 160 rotate as shown by the double-headed arrows. In addition, it is appreciated from the double-headed arrows that the rollers 160 can rotate in a clockwise (CW) and/or counterclockwise (CCW) direction.

In some instances, the rollers 160 rotate freely as a result of movement relative to the piece of sheet metal 200 during the positive movement of the male die tool 150. In other instances, the rollers 160 rotate forcibly against the sheet metal 200 in contact therewith during positive movement of the male die tool 150 indicated by arrow 2. In addition, the rollers 160 can rotate forcibly against the sheet metal 200 during and/or after movement of the male die tool 150 in the positive direction 2. The rollers 160 are mechanically coupled to an external force 162 that can include an electric motor mechanically coupled to the roller, a gas powered motor coupled to the roller, and the like.

In Step 3, the male die tool 150 is moved in a negative direction and the finished sheet metal component is shown at Step 4. As shown in Step 4, the amount of springback illustrated by the angle $\theta_2$ is much less than $\theta_1$ shown in FIG. 1. As such, the rotation of the rollers 160 relative to the male die tool 150 and/or relative to the sheet metal 200 results in decreased springback with respect to corners 203. However, and as illustrated by the angle $\gamma_1$, the corners 205 that are present between the side portions 204 and tail or ear portions 206 still exhibit appreciable springback.

Figure 3A:
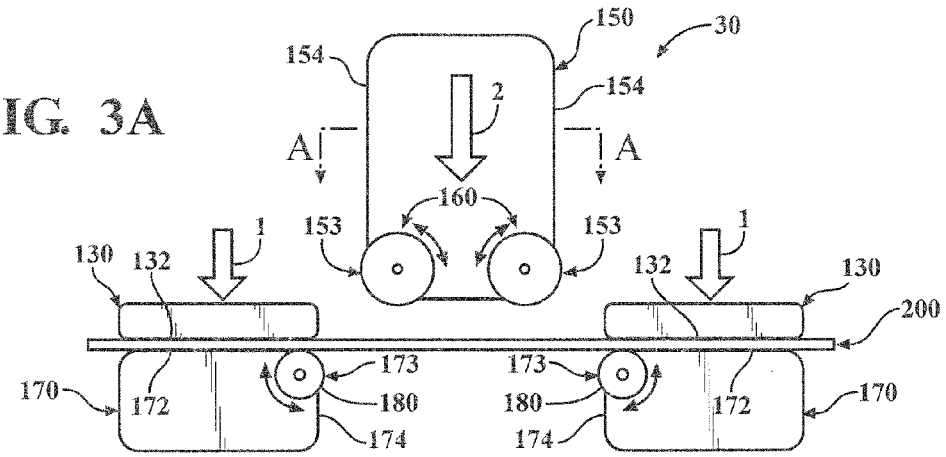
FIG. 3A is a schematic illustration of a sheet metal forming process according to another embodiment disclosed herein.
Figure 3B:
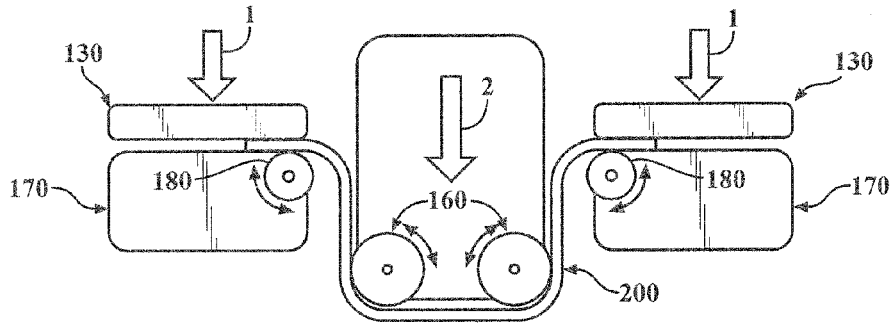
FIG. 3B is a schematic illustration of continued forming of a sheet metal component using the embodiment shown in FIG. 3A.

In order to reduce the springback at the corner locations 205, FIG. 3A provides a schematic illustration of another embodiment of a sheet metal forming device at reference numeral 30. The sheet metal forming device 30 has a similar male forming die tool 150 with the pair of rollers 160 that form at least part of the corners 153. In addition, the female die tool 120 is replaced with a female die tool 170 that has a pair of rollers 180 that form at least part of corners 173 that are present between a top surface 172 and side surfaces 174. As such, during forming of the sheet metal component 200 as illustrated in FIG. 3B, the rollers 180 rotate relative to the female die tool 170 during and/or after movement of the male die tool 150 in the positive direction 2. In addition, the rollers 180 can rotate freely and/or forcibly rotate relative to the sheet metal 200.

It is appreciated that the gap between the male die tool 150 and the female die tool 170 shown in the figures is not to scale. Stated differently, the male die tool 150 and female die tool 170 can have sufficient spacing therebetween such that the rollers 180 rotate against the corners 205 of the sheet metal component 200.

Figure 3C:
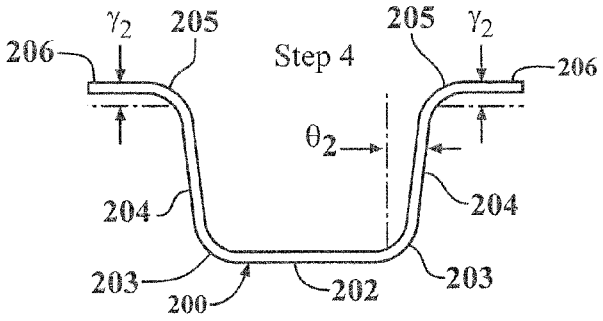
FIG. 3C is a schematic illustration of a sheet metal component that has been formed using the embodiment in FIG. 3A.

FIG. 3C provides an illustration of the sheet metal component 200 after being formed by the sheet metal device 30 and as shown in the figure, the springback of the corner 205 is greatly reduced as illustrated by the angle $\gamma_2$ when compared to $\gamma_1$ of FIG. 2.

Figure 4:
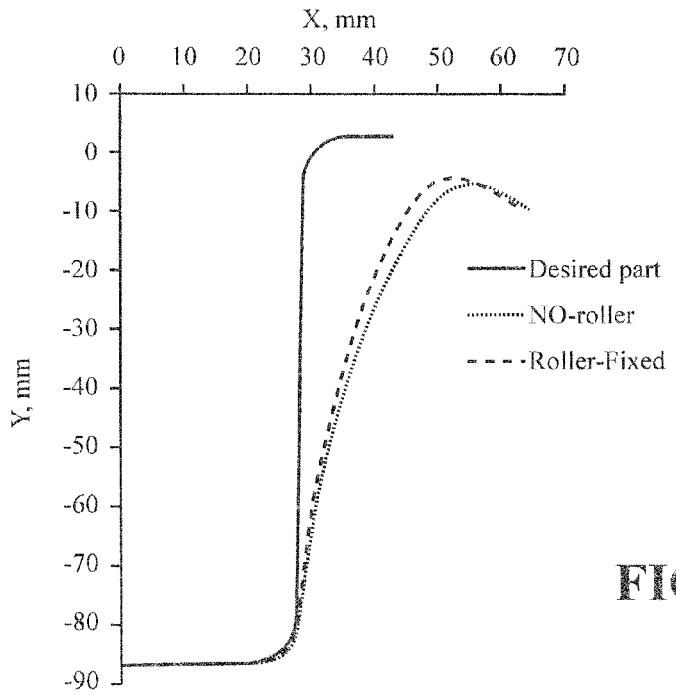
FIG. 4 is a series of illustrative side view outlines for a desired sheet metal component; a sheet metal component formed using a die without a roller; and a sheet metal component formed using a die with a roller, but with the roller fixed in place, i.e. not rotating.

Turning now to FIG. 4, a graphical illustration of a side-view for a desired sheet metal part or component compared to a simulated formulation for a formed component is shown. As shown in the figure, the desired part, which is represented by the solid line, has a generally 90 degree angle between the bottom portion and the side portion and another generally 90 degree angle between the side portion and the top portion of the sheet metal component. However, when formed with a male die tool that does not have a roller, the springback at both corners is evident. In addition, when formed with a male die tool that has a roller that is fixed, significant springback is still exhibited.

Figure 5:
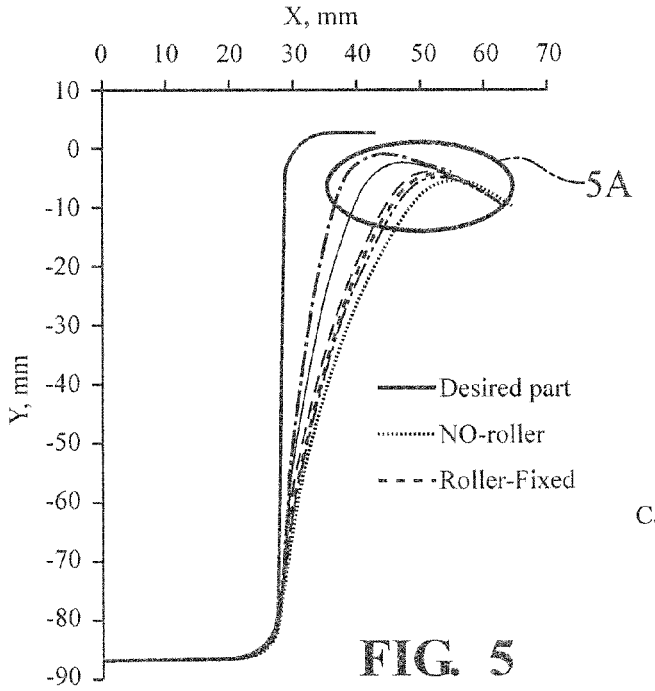
FIG. 5 is a series of illustrative side view outlines for sheet metal components formed according to one or more embodiments disclosed herein.
Figure 5A:
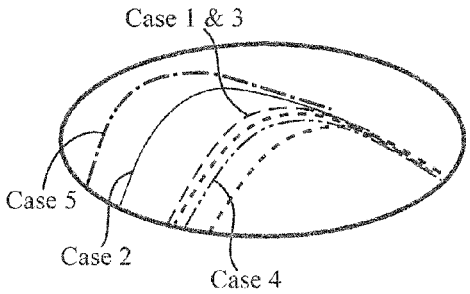
FIG. 5A is an enlarged section of the circled region labeled 5A in FIG. 5.

In contrast, FIG. 5 illustrates results for when rollers such as rollers 160 and 180 illustrated in FIG. 3 are rotated during the forming process. In particular, the label Case 1 refers to the male die tool roller 160 rotating in a CW direction and the female die roller 180 rotating in a CCW direction and vice-versa for Case 3. Case 2 refers to the male die roller 160 rotating in a CW direction and the female die roller 180 rotating in the CW direction. Case 4 refers to the male die tool roller 160 rotating in the CCW direction and the female die tool roller 180 rotating in the CCW direction. Finally, case 5, which shows the least amount of springback, refers to the male die tool roller 160 rotating in the CW direction, the female die tool roller 180 rotating CW, and a friction coefficient of 0.2 imposed between the male die tool roller 160—sheet metal 200 interfaces and the female die tool roller 180—sheet metal 200 interfaces. As such, it is appreciated that the role of friction during the forming process can play an important role.

Figure 6:
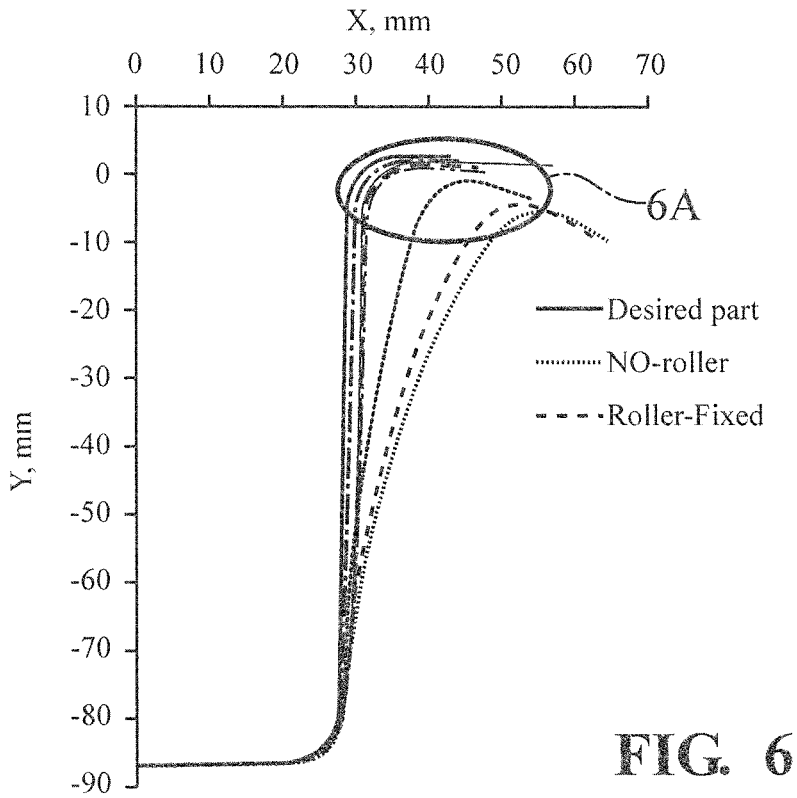
FIG. 6 is a series of illustrative side view outlines for sheet metal components formed according to one or more embodiments disclosed herein.
Figure 6A:
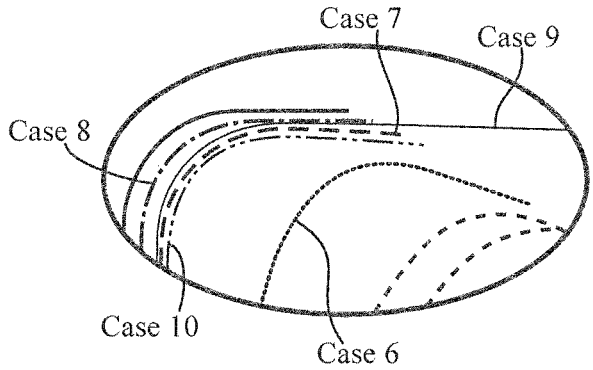
FIG. 6A is an enlarged section of the region labeled 6A in FIG. 6.

Turning now to FIG. 6, simulated results for various sheet metal components formed under different conditions are shown. In particular, FIG. 6A shows an enlarged view of the various outlines shown in FIG. 6. In addition, Case 6 illustrates the result of rollers such as rollers 160 and 180 forcibly rotating with two revolutions during the male die tool 150 moving in the positive direction 2. Case 7 refers to rollers 160 and 180 forcibly rotating with ten revolutions during positive movement of the male die tool 150. Case 8 refers to forcible rotation of rollers 160 and 180 for twenty revolutions during positive movement. Case 9 refers to thirty revolutions of the rollers 160 and 180. Finally, Case 10 demonstrates the results for the female die tool roller 180 being fixed, i.e. not rotating, while the male die roller 160 had twenty revolutions during the male die tool 150 moving in the positive direction 2. As shown by FIGS. 6 and 6A, the use of additional rotations of the rollers, i.e. forcible rotation of the rollers, results in a significant reduction in springback.

Figure 7:
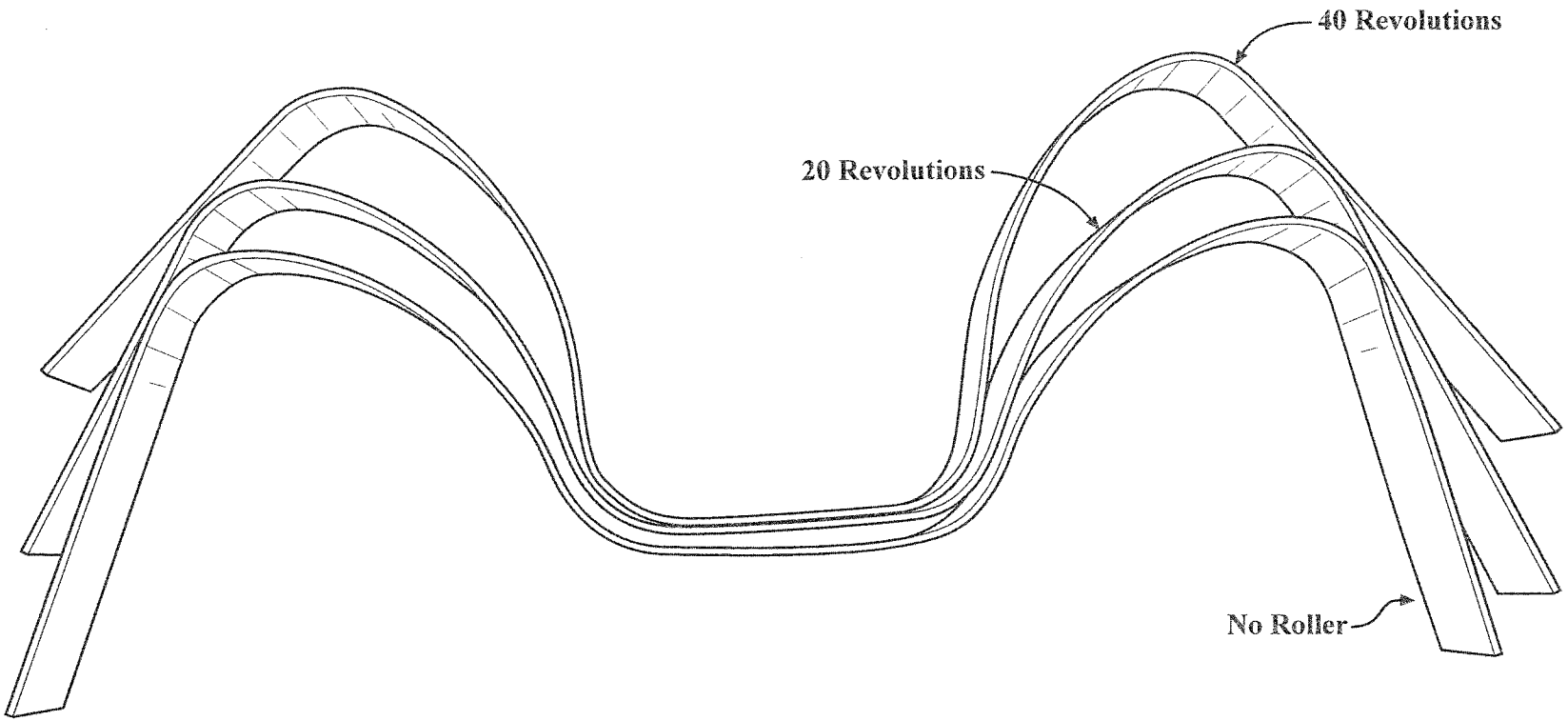
FIG. 7 is a series of schematic illustrations for sheet metal strips formed according to one or more embodiments disclosed herein.

Turing now to FIG. 7, line drawings for actual sheet metal strips that were formed using a sheet metal forming device as illustratively shown in FIG. 2 are shown. In addition, the labeling of "No Roller", "20 revolutions", and "40 revolutions" refers to the number of rotations or revolutions that the sheet metal strip was subjected to by the male die tool roller 160. As shown in the figure, the revolutions result in a substantial reduction in springback for the corners that were formed by and located at the bottom of the male die tool 150.

Figure 8:
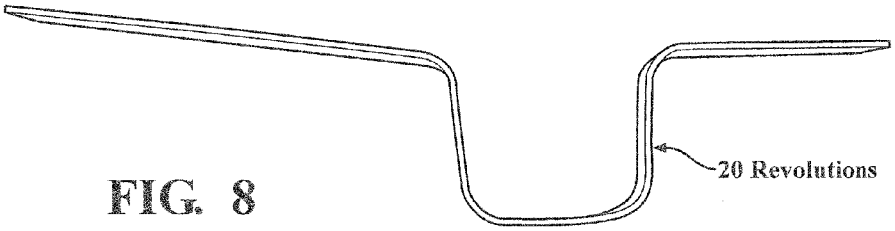
FIG. 8 is a schematic illustration for a sheet metal strip formed according to an embodiment disclosed herein.

FIG. 8 is another line drawing for an actual piece of sheet metal strip that was subjected to forming in which male die tool rollers 160 made 20 revolutions with sheet metal strip was pinched more in between tool 120 and 130 and the male tool 150 had moved in the positive direction 2. As shown in FIG. 8, springback at corners corresponding to the male die tool and the female die tool is greatly reduced.

Figure 9A:
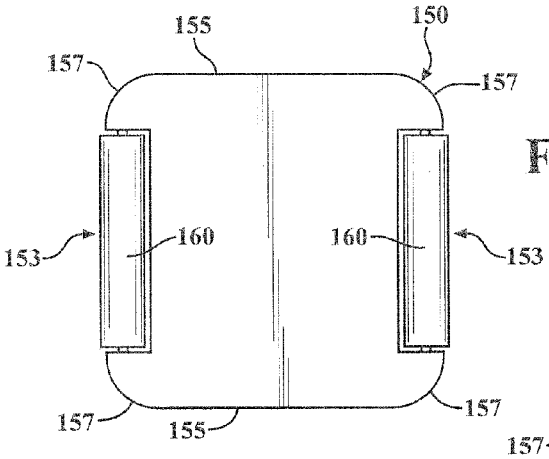
FIG. 9A is a cross-sectional view of section A-A in FIG. 3A.
Figure 9B:
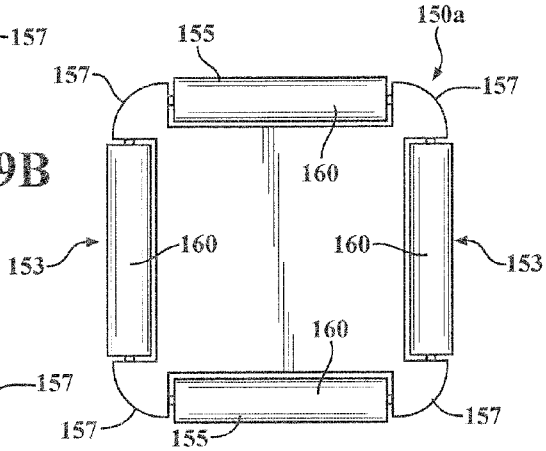
FIG. 9B is a cross-sectional view of the embodiment shown in FIG. 9A with the addition of two more rollers.
Figure 9C:
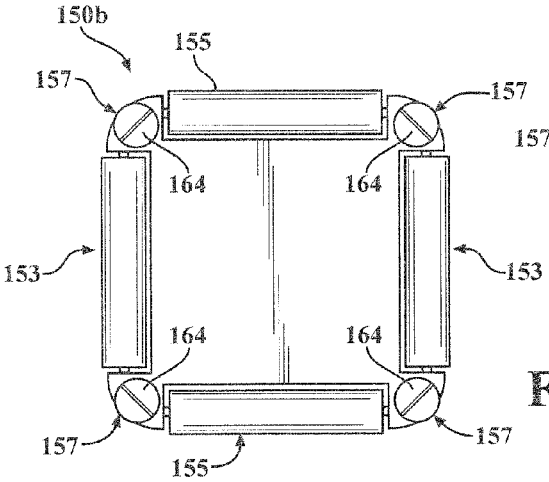
FIG. 9C is a cross-sectional view of the embodiment shown in FIG. 9A with the addition of six more rollers.

Turning now to FIGS. 9A-9C, different embodiments of the male die tool are shown. FIG. 9A corresponds to section A-A shown in FIG. 3A. As shown in FIG. 9A, rollers 160 are located at corners 153, but corners 155 of the male die tool 150 do not have rollers. However, FIG. 9B illustrates rollers 160 at the corners 155 for an embodiment 150*a* of the male die tool. Finally, FIG. 9C illustrates male die tool 150*b* in which rollers 160 are at corners 153 and 155 and spherical rollers 164 are present at corners 157 that adjoin corners 153 and 155. It is appreciated that the rollers are forcibly rotated through any gearing and/or shaft mechanism known to those skilled in the art such that the rollers rotate relative to the die tool, and in some instances relative to a sheet metal component being formed by the die tool.

In this manner, the production of sheet metal components with reduced springback is provided. It is appreciated that different materials, alloys, etc., exhibit different amounts of springback in forming operations. As such, the amount or number of forcible rotations can vary depending on the material. In addition, forcible rotations can occur during positive movement of a die tool, i.e. not just after the die tool has stopped positive movement.

Given the above teachings, it should be appreciated that modifications, changes, and the like to the instant disclosure will be apparent to those skilled in the art and yet fall within the scope of the present invention. As such, it is the claims, and all equivalents thereof, that define the scope of the invention.

The invention claimed is:

1. A sheet metal forming device comprising:

a female die (FD) tool with a FD corner and a male die (MD) tool with a MD corner, said MD tool dimensioned to slide at least partially within said FD tool during forming of a piece of sheet metal; and a MD roller, said MD corner of said MD die tool at least partially formed by said MD roller;

an external mechanical force selected from the group consisting of an electric motor mechanically coupled to said MD roller and a gas powered motor mechanically coupled to said MD roller;

said MD roller rotating forcibly relative to said MD die tool during forming of the piece of sheet metal by said MD die tool;

wherein said external mechanical force is configured to forcibly rotate said MD roller relative to said MD tool after said MD tool stops sliding within said FD tool.

2. The sheet metal forming device of claim 1, wherein said MD tool has a pair of MD corners and a pair of MD rollers with said external mechanical force mechanically coupled to said pair of MD rollers, each of said MD corners at least partially formed by one of said MD rollers and each of said MD rollers rotating relative to said MD tool during forming of the piece of sheet metal by said MD tool;

wherein said mechanical external force is configured to forcibly rotate said pair of MD rollers relative to said MD tool after said MD tool stops sliding within said FD tool.

3. The sheet metal forming device of claim 2, wherein said FD tool has an FD roller, said FD corner of said FD tool at least partially formed by said FD roller, said FD roller rotating relative to said FD tool during forming of the piece of sheet metal.

4. The sheet metal forming device of claim 3, wherein said FD roller rotating relative to said FD tool is selected from the group consisting of said FD roller rotating freely and said FD roller rotating forcibly.

5. The sheet metal forming device of claim 4, wherein said FD roller is configured to forcibly rotate relative to said FD tool after said MD tool stops sliding within said FD tool.

6. The sheet metal forming device of claim 1, wherein said FD tool has a pair of FD corners and a pair of FD rollers, each of said FD corners at least partially formed by one of said FD rollers and each of said FD rollers rotating relative to said FD tool during forming of the piece of sheet metal.

7. A process for forming a piece of sheet metal comprising:

providing a metal forming device with:

a female die (FD) tool with a FD die corner and a male die tool (MD) with a MD corner, the MD tool dimensioned to slide at least partially within the FD tool during forming of a piece of sheet metal;

a MD roller, said MD corner of the MD tool at least partially formed by the MD roller;

providing a piece of sheet metal and placing the piece of sheet metal in contact with the FD die tool; and forming the piece of sheet metal with the metal forming device by bending the piece of sheet metal around the MD tool corner as the MD tool slides within the FD tool with the MD roller rotating relative to the MD tool during forming of the piece of sheet metal with an external mechanical force forcibly rotating the MD roller relative to the MD tool after the MD tool stops sliding within the FD tool;

wherein rotation of the MD roller reduces an amount of springback by the piece of sheet metal.

8. The process of claim 7, wherein the FD tool has an FD corner and an FD roller, said FD corner at least partially formed by said FD roller, the FD roller rotating relative to the FD tool during forming of the piece of sheet metal.

9. The process of claim 8, further including the FD roller forcibly rotating relative to the FD tool after the MD tool stops sliding within the FD tool.

10. A sheet metal forming device comprising:

a female die (FD) tool with a FD corner and a male die (MD) tool with a MD corner, said MD tool dimensioned to slide at least partially within said FD tool during forming of a piece of sheet metal; and a FD roller, said FD corner of said FD die tool at least partially formed by said FD roller;

an external mechanical force selected from the group consisting of an electric motor mechanically coupled to said FD roller and a gas powered motor mechanically coupled to said FD roller;

said FD roller rotating forcibly to said FD die tool during forming of the piece of sheet metal by said MD tool;

wherein said external mechanical force is configured to forcibly rotate said FD roller relative to said FD tool after said MD tool stops sliding within said FD tool.

11. The sheet metal forming device of claim 10, wherein said FD tool has a pair of FD corners and a pair of FD rollers with said external mechanical force mechanically coupled to said pair of FD rollers, each of said FD corners at least partially formed by one of said FD rollers and each of said FD rollers rotating relative to said FD tool during forming of the piece of sheet metal by said MD tool;

wherein said mechanical external force is configured to forcibly rotate said pair of FD rollers relative to said FD tool after said MD tool stops sliding within said FD tool.

12. The sheet metal forming device of claim 10, wherein said MD tool has an MD roller, said MD corner of said MD tool at least partially formed by said MD roller, said MD roller rotating relative to said MD tool during forming of the piece of sheet metal.

13. The sheet metal forming device of claim 12, wherein said MD roller rotating relative to said MD tool is selected from the group consisting of said MD roller rotating freely and said MD roller rotating forcibly.

14. The sheet metal forming device of claim 13, wherein said MD roller is configured to forcibly rotate relative to said MD tool after said MD tool stops sliding within said FD tool.

15. The sheet metal forming device of claim 10, wherein said MD tool has a pair of MD corners and a pair of MD rollers, each of said MD corners at least partially formed by one of said MD rollers and each of said MD rollers rotating relative to said FD tool during forming of the piece of sheet metal.

* * * * *